US011097541B2

(12) United States Patent
Tanaka

(10) Patent No.: US 11,097,541 B2
(45) Date of Patent: Aug. 24, 2021

(54) LIQUID DISCHARGING HEAD

(71) Applicant: Brother Kogyo Kabushiki Kaisha, Nagoya (JP)

(72) Inventor: Taiki Tanaka, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/832,103

(22) Filed: Mar. 27, 2020

(65) Prior Publication Data

US 2020/0384768 A1 Dec. 10, 2020

(30) Foreign Application Priority Data

Jun. 7, 2019 (JP) ..... JP2019-106739

(51) Int. Cl.
*B41J 2/14* (2006.01)

(52) U.S. Cl.
CPC ..... *B41J 2/14201* (2013.01); *B41J 2/1433* (2013.01); *B41J 2002/14419* (2013.01)

(58) Field of Classification Search
CPC ..... B41J 2/14201; B41J 2/1433; B41J 2002/14419; B41J 2/14427
USPC ..... 347/20, 54, 68, 84, 85
See application file for complete search history.

(56) References Cited

U.S. PATENT DOCUMENTS

| | | | | |
|---|---|---|---|---|
| 9,731,506 | B2 * | 8/2017 | Tanaka | H01L 41/0475 |
| 10,766,257 | B2 * | 9/2020 | Kato | B41J 2/155 |
| 2015/0130877 | A1 | 5/2015 | Takabe | |
| 2017/0217172 | A1 * | 8/2017 | Naganuma | B41J 2/0453 |

FOREIGN PATENT DOCUMENTS

JP 2018-027711 A 2/2018

* cited by examiner

*Primary Examiner* — An H Do
(74) *Attorney, Agent, or Firm* — Banner & Witcoff, Ltd.

(57) ABSTRACT

A liquid discharging head including a flow path member with layered plates is provided. The flow path member includes a common flow path, pressure-chamber inclusive flow paths, discharging flow paths, at least one supplying flow path. The pressure-chamber inclusive flow paths are formed in a part of the plates belonging to a first plate group and are arrayed in the first direction. The discharging flow paths are formed in another part of the plates belonging to a second plate group. The at least one supplying flow path is formed in at least one of the plates belonging to a third plate group. The third plate group includes at least one of the part of the plates belonging to the second plate group. The at least one supplying flow path has a connecting portion connected with at least two of the pressure-chamber inclusive flow paths.

17 Claims, 5 Drawing Sheets

LIQUID DISCHARGING HEAD

CROSS REFERENCE TO RELATED APPLICATION

This application claims priority from Japanese Patent Application No. 2019-106739, filed on Jun. 7, 2019, the entire subject matter of which is incorporated herein by reference.

BACKGROUND

Technical Field

An aspect of the present disclosure is related to a liquid discharging head.

Related Art

An inkjet recording head, including a flow path formation board, a communication board, and a nozzle plate, is known. In the flow path formation board, a plurality of pressure generating chambers ("pressure chambers") may be formed. In the communication board, a nozzle communication path and a supplying communication path may be formed for each of the pressure chambers. In the nozzle plate, a plurality of nozzle openings, each of which communicates individually with one of the pressure chambers, may be formed. The flow path formation board, the communication board, and the nozzle plate may be joined to one another to form a head body in the inkjet recording head. The supplying communication paths formed in the communication board may be in communication with a second manifold, which is formed in a lower part of the communication board, and a first manifold, which is formed through the communication board, and a third manifold, which is formed in a casing located at an upper position with respect to the flow path formation board. Ink in the supplying communication path may be supplied to the pressure chambers through a flow path including the third manifold, the first manifold, and the second manifold.

SUMMARY

In this inkjet recording head, in order to avoid shortage in ink supply to refill the pressure chambers during image recording, it may be important to reduce potential resistance producible in the flow path between the third manifold to the pressure chambers. In particular, if viscous ink is to be discharged in a high driving frequency, the ink to refill the pressure chambers may not be supplied properly, and the ink supply to the pressure chambers may fail. In order to restrain shortage of the refilling ink, while the one-to-one correspondence between the supplying communication paths and the pressure chambers, in which the supplying communication paths and the pressure chambers are connected with each other on the one-to-one basis, may be maintained, a diameter of each supplying communicating path may be enlarged, and dimensions of each pressure chamber may be increased. However, the pressure chambers may be already arranged in the head body in a high density. Therefore, in order to increase the dimensions of the pressure chambers, it may be necessary that the positions of the pressure chambers are rearranged, and the nozzle openings may need to be arrayed at larger intervals.

The present disclosure is advantageous in that a liquid discharging head, in which nozzle openings may be arranged at smaller intervals, and shortage of refilling liquid may be restrained, is provided.

According to an aspect of the present disclosure, a liquid discharging head, including an actuator and a flow path member including a plurality of plates being layered is provided. The flow path member is formed to have a common flow path, a plurality of pressure-chamber inclusive flow paths, a plurality of discharging flow paths, and at least one supplying flow path. The common flow path extends in a first direction. The plurality of pressure-chamber inclusive flow paths are formed in a part of the plurality of plates belonging to a first plate group. Each of the plurality of pressure-chamber inclusive flow paths includes a pressure chamber. The plurality of pressure-chamber inclusive flow paths are arrayed in the first direction. The plurality of discharging flow paths are formed in another part of the plurality of plates not belonging to the first plate group but belonging to a second plate group. Each of the plurality of discharging flow paths extends in a second direction from the pressure chamber in each of the plurality of pressure-chamber inclusive flow paths. The second direction intersects orthogonally with the first direction. Each of the plurality of discharging flow paths has a nozzle opening at one end thereof. The at least one supplying flow path is formed in at least one of the plurality of plates belonging to a third plate group. The third plate group includes at least one of the part of the plurality of plates belonging to the second plate group. The at least one supplying flow path connects the common flow path with the plurality of pressure-chamber inclusive flow paths. The at least one supplying flow path each has a connecting portion. The connecting portion extends from one end on a boundary with the plurality of pressure-chamber inclusive flow path in parallel with a direction extending from the pressure chamber toward the nozzle opening in each of the pressure-chamber inclusive flow paths. The connecting portion each is connected with at least two of the plurality of pressure-chamber inclusive flow paths.

According to another aspect of the present disclosure, a liquid discharging head, including an actuator and a flow path member is provided. The flow path member is formed to have a common flow path, a nozzle opening, a plurality of pressure-chamber inclusive flow paths, a descender flow path, and a supplying flow path. The common flow path extends in a first direction. The plurality of pressure-chamber inclusive flow paths each includes an anterior chamber, a pressure chamber, and a funnel. The funnel is a narrowed flow path formed between the anterior chamber and the pressure chamber. The descender flow path connects the pressure chamber with the nozzle opening in a second direction. The second direction intersects orthogonally with the first direction. The supplying flow path connects the common flow path with the anterior chamber. The supplying flow path is connected with at least two of the plurality of pressure chamber inclusive flow paths each through the anterior chamber.

According to still another aspect of the present disclosure, a liquid discharging head, including an actuator and a flow path member, is provided. The flow path member includes a first plate, a second plate, and a third plate. The first plate has a first through hole for a common flow path extending in a first direction and second through holes. The second through holes each include an anterior chamber, a pressure chamber, and a funnel. The second plate has a plurality of nozzle openings. The third plate has a third through hole for the common flow path, a plurality of fourth holes each for a descender flow path, and a fifth hole for a supplying flow path. The plurality of fourth holes each connects one of a plurality of pressure chambers included in the second through holes with one of the plurality of the nozzle openings in a second direction. The second direction intersects orthogonally with the first direction. The fifth hole connects the third through hole with at least two anterior chambers included in the second through holes.

BRIEF DESCRIPTION OF THE ACCOMPANYING DRAWINGS

Figure 3A:
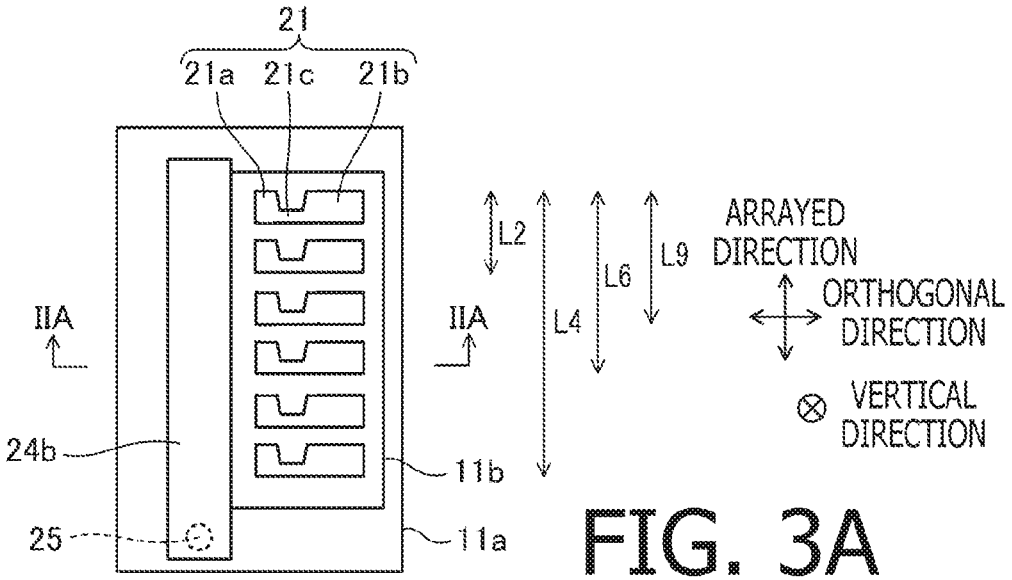
Figure 3B:
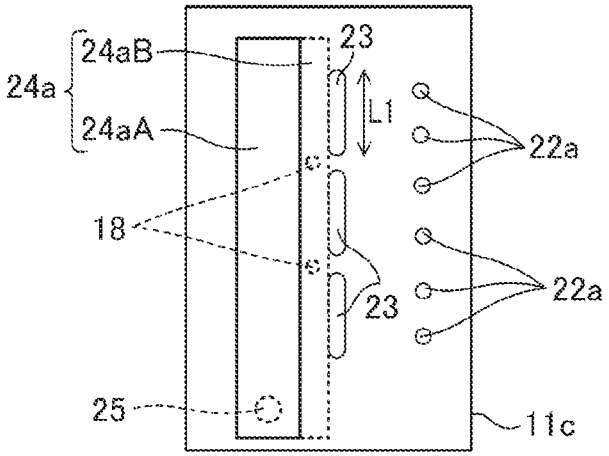
Figure 3C:
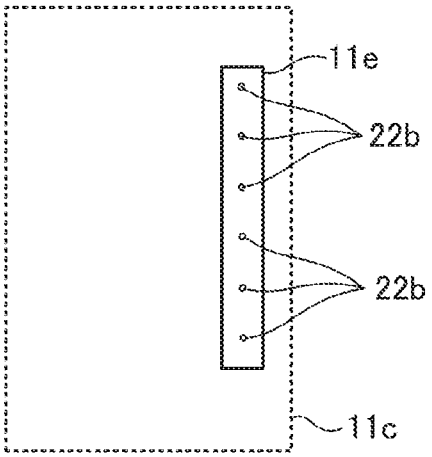

FIGS. 3A-3C are simplified plan views of a reservoir plate 11*a* and a pressure chamber plate 11*b*, a flow path plate 11*c*, and a nozzle plate 11*e*, respectively, which constitute the head 1, according to the embodiment of the present disclosure.

Figure 4:
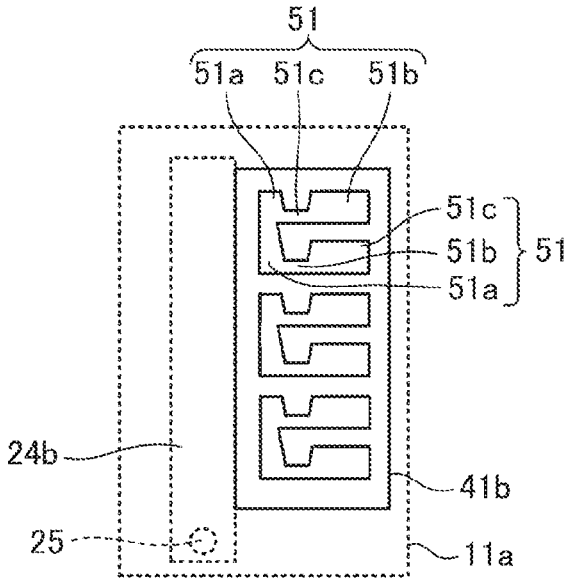

FIG. 4 is a simplified plan view of a pressure chamber plate 41*b* according to a first modified example of the embodiment of the present disclosure.

Figure 5:
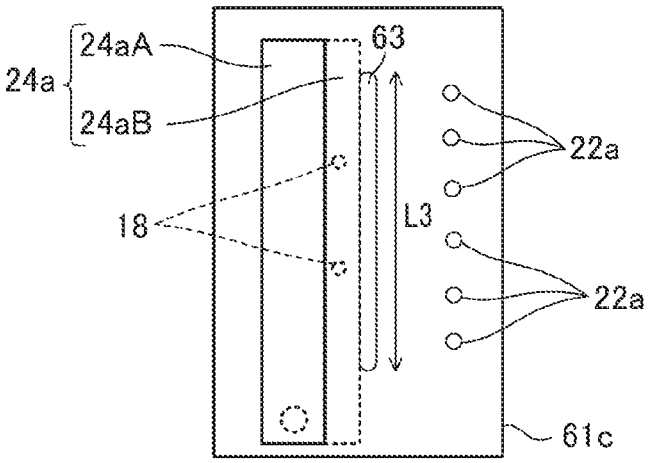

FIG. 5 is a simplified plan view of a flow path plate 61*c* according to the first modified example of the embodiment of the present disclosure.

Figure 6A:
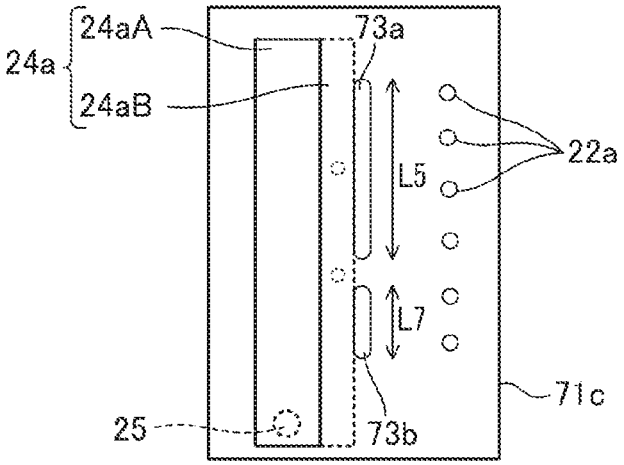
Figure 6B:
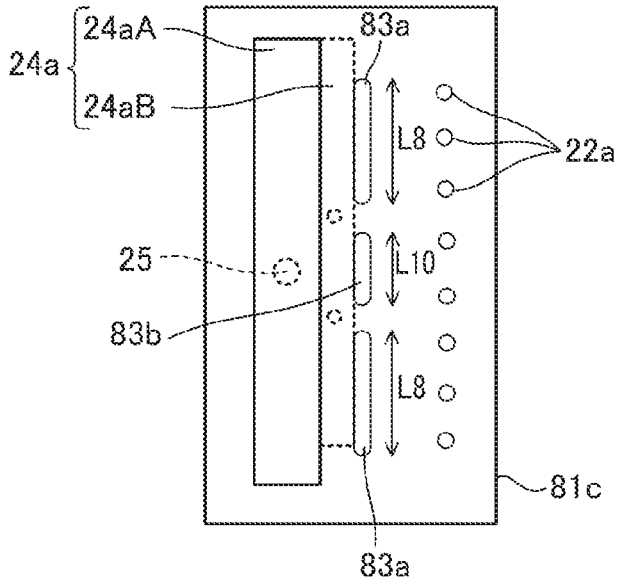

FIG. 6A is a simplified plan view of a flow path plate 71*c* according to a second modified example of the embodiment of the present disclosure. FIG. 6B is a simplified plan vie of a flow path plate 81*c* according to a third modified example of the embodiment of the present disclosure.

DETAILED DESCRIPTION

Figure 1:
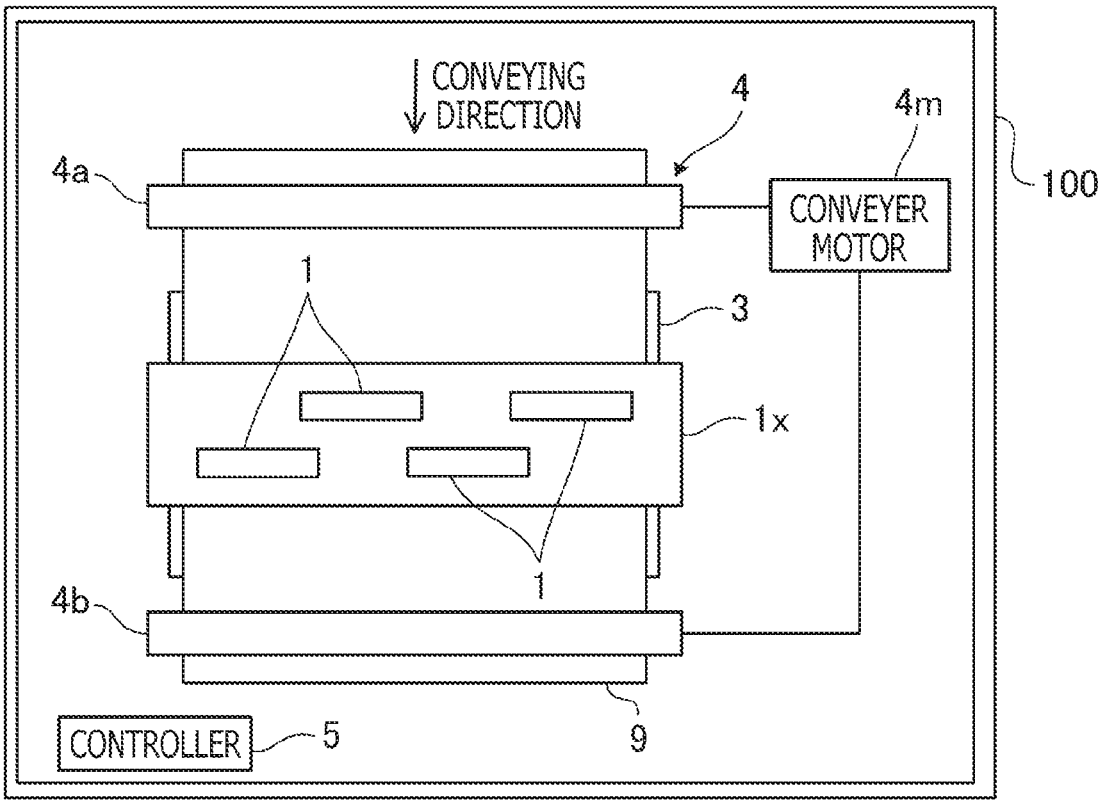
FIG. 1 is a plan view of a printer 100 having heads 1 according to an embodiment of the present disclosure.

With reference to FIG. 1, in the following paragraphs, an overall configuration of the printer 100 having a head unit 1*x*, which includes the heads 1 according to the embodiment of the present disclosure will be described. The printer 100 includes, further to the head unit 1*x*, a platen 3, a conveyer 4, and a controller 5.

The head unit 1*x* is a line-printing inkjet head, which may discharge ink at a sheet 9 while situated at a fixed position. The head unit 1*x* extends longitudinally in a direction intersecting orthogonally with a conveying direction. The direction intersecting orthogonally with the conveying direction may later be referred to as an arrayed direction. The head unit 1*x* includes four (4) heads 1, which have a same configuration and are arrayed alternately in zigzag along the direction orthogonal to the conveying direction. Each head 1 has a plurality of nozzle openings 22*b* (see FIG. 2A), through which ink may be discharged.

The platen 3 is arranged at a lower position with respect to the head unit 1*x*. The platen 3 may support the sheet 9 thereon, and ink may be discharged from the heads 1 at the sheet 9 being supported.

The conveyer 4 includes two (2) roller pairs 4*a*, 4*b*, which are arranged on one side and the other side of the platen 3 in the conveying direction. As a conveyer motor 4*m* operates, two (2) rollers in each of the roller pairs 4*a*, 4*b* may rotate in directions opposite to each other so that the sheet 9 nipped between the rollers in at least one of the roller pairs 4*a*, 4*b* may be conveyed in the conveying direction.

The controller 5 may control the heads 1 and the conveyer motor 4*m* to record an image on the sheet 9 based on a recording command input through an external device, such as a personal computer (PC).

Figure 2A:
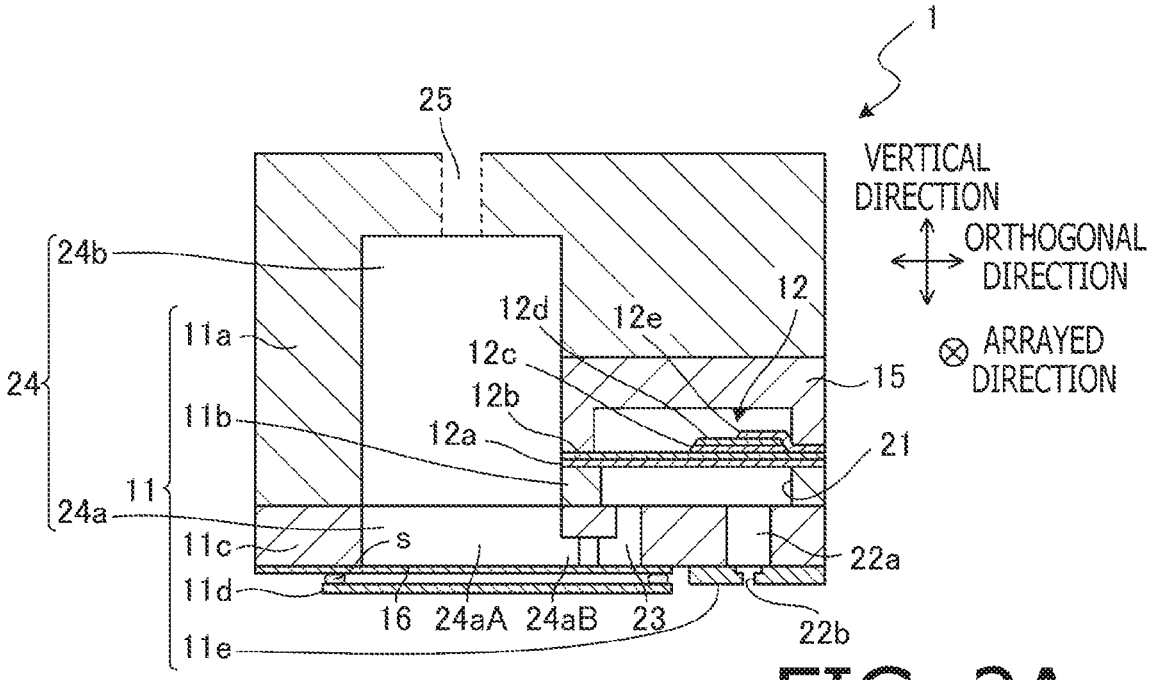
FIG. 2A is a cross-sectional view of one of the heads 1 according to the embodiment of the present disclosure.

Next, with reference to FIGS. 2A-2B and 3A-3C, a representing one of the heads 1 will be descried. The head 1 includes a flow path member 11, an actuator unit 12, and a protector member 15. It may be noted that FIG. 2A shows a cross-section of the head 1 viewed at a line IIA-IIA indicated in FIG. 3A.

The flow path member 11 includes a reservoir plate 11*a*, a pressure chamber plate 11*b*, a flow path plate 11*c*, a protector plate 11*b*, and a nozzle plate 11*e*, which are adhered to one another. In the flow path member 11, a plurality of pressure-chamber inclusive flow paths 21, a plurality of discharging flow paths 22, a plurality of supplying flow paths 23, and a common flow path 24 are formed. In particular, the pressure-chamber inclusive flow paths 21 are formed in the pressure chamber plate 11*b*, and the supplying flow paths 23 are formed in the flow path plate 11*c*.

The pressure-chamber inclusive flow paths 21 each include an anterior chamber 21*a*, a pressure chamber 21*b*, and a funnel 21*c*. The anterior chamber 21*a* is connected with one of the supplying flow paths 23, and the pressure chamber 21*b* is connected with one of the discharging flow paths 22. The funnel 21 is a narrowed flow path formed between the anterior chamber 21*a* and the pressure chamber 21*b*.

The discharging flow paths 22 each include a descender flow path 22*a*, which is formed in the flow path plate 11*c*, and the nozzle opening 22*b*, which is formed in the nozzle plate 11*e*. A diameter of the nozzle opening 22*b* is substantially smaller than a diameter of the descender flow path 22*a*.

The pressure chamber plate 11*b* is formed of a silicon single crystal board, in which, as shown in FIG. 3A, through holes being the plurality of pressure-chamber inclusive flow paths 21 being through holes are formed. It may be noted in FIG. 3A that merely six (6) pressure-chamber inclusive flow paths 21 are representatively illustrated for simplified explanation; however, in practical use, a larger quantity of pressure-chamber inclusive flow paths 21 may be formed in the pressure chamber plate 11*b*. The plurality of pressure chambers 21*b* in the pressure-chamber inclusive flow paths 21 are arrayed in line to form a pressure chamber array extending in the longitudinal direction of the head 1. The pressure chambers 21*b* forming the pressure chamber array are arranged at equal intervals along the arrayed direction, which is the direction intersecting orthogonally with the conveying direction.

The flow path plate 11*c* is formed of a silicon single crystal board, having a plane size marginally larger than the pressure chamber plate 11*b*, and is adhered to a lower face of the pressure chamber plate 11*b*. In the flow path plate 11*c*, as shown in FIG. 3B, a manifold 24*a*, a plurality of supplying flow paths 23, and a plurality of descender flow paths 22*a* are formed. The manifold 24*a* forms a part of the common flow path 24. Each of the supplying flow paths 23 connects the manifold 24*a* with a plurality of or at least two (2) of the anterior chambers 21*a*. Each of the descender flow paths 22*a* connects one of the pressure chambers 21*b* with one of the nozzle openings 22*b*. In the present embodiment, with respect to the plurality of pressure chamber inclusive flow paths 21, solely one (1) manifold 24*a* is provided. Meanwhile, a number of the discharging flow paths 22 is equal to the number of the pressure-chamber inclusive flow paths 21. For example, in FIGS. 3A-3C, six (6) discharging flow paths 22 may be provided for six (2) pressure-chamber inclusive flow paths 21. It may be noted in FIG. 3B that a position of a communication hole 25, which will be described later in detail, formed in the reservoir plate 11*a* is illustrated in broken lines.

In the meantime, a number of the supplying flow path 23 is a half (½) of the number of the pressure-chamber inclusive flow paths 21. For example, as shown in FIGS. 3A-3B, three (3) supplying flow paths 23 may be provided for the six (6) pressure-chamber inclusive flow paths 21. A length L1 of each supplying flow path 23 in the arrayed direction is equal to a length L2, which is a sum of a distance between two (2) adjoining pressure-chamber inclusive flow paths 21 and lengths of the two adjoining pressure chamber inclusive flow paths 21 in the arrayed direction. For example, the length L1 may be 150-160 μm, the distance between the adjoining pressure-chamber inclusive flow paths 21 may be 10-20 μm, and a length of each pressure-chamber inclusive flow path 21 in the arrayed direction may be 60-80 μm. In this arrangement, one (1) supplying flow path 23 is connected with two (2) pressure-chamber inclusive flow paths 21 which adjoin each other in the arrayed direction. While the pressure chambers 21 and the respective nozzle openings 22*b* may align in, for example, the vertical direction, each supplying flow path 23 includes a connecting portion that extends straight in parallel with a direction extending from the pressure chamber 21 toward the nozzle opening 22*b*, e.g., vertically, from one end, e.g., an upper end in FIG. 2B, on a boundary Px between the supplying flow path 23 and the pressure-chamber inclusive flow paths 21. In other words, the supplying flow path 23 may consist of the connecting portion.

Moreover, as shown in FIG. 3B, a cross-sectional shape of the supplying flow path 23, on a plane spreading orthogonally to a flowing direction for the ink, is round or semicircular at each longitudinal end in the arrayed direction with a middle portion between the semicircles at the longitudinal ends having linear outlines that extend in parallel with each other. In other words, an outline of the cross-sectional shape of the supplying flow path 23 has no corner. Therefore, air bubbles may not easily be caught to stay in the supplying flow path 23. However, the cross-sectional shape of the supplying flow path 23 may not necessarily be limited to the semicircular ends with the liner middle portion as long as the outline thereof has no corner but may have a shape of, for example, an oval.

Figure 2B:
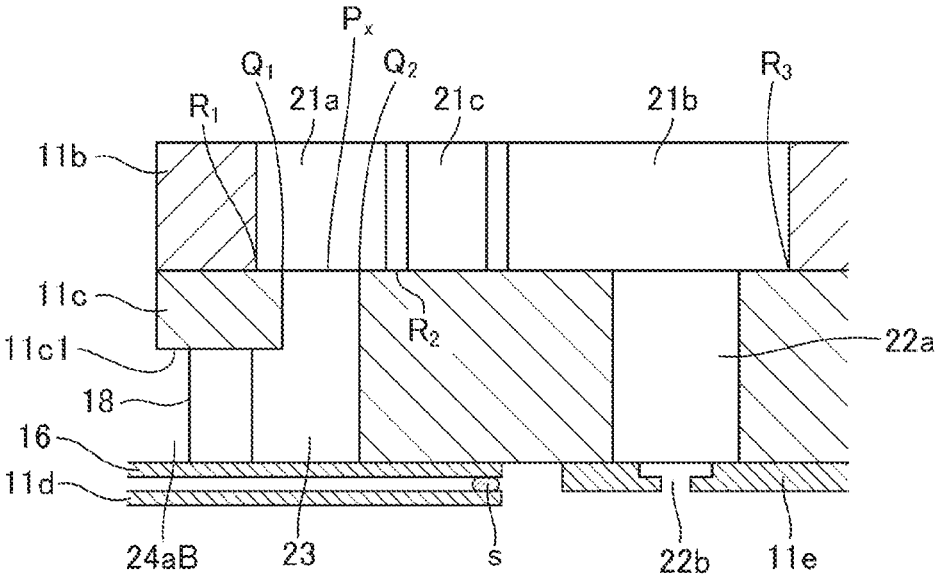
FIG. 2B is a partially enlarged cross-sectional view of the head 1 according to the embodiment of the present disclosure.

As shown in FIG. 2B, edges of each pressure chamber inclusive flow path 21 are defined by sides R1, R2, R3. Meanwhile, edges Q1, Q2 of the supplying flow path 23 in an orthogonal direction, which intersects orthogonally with the arrayed direction and the vertical direction, on the boundary Px with the pressure-chamber inclusive flow paths 21 are located on an inner side of the edges R1, R3 of the pressure-chamber inclusive flow paths 21 in the orthogonal direction on a plane including the boundary Px. In other words, in a plan view along the vertical direction, the edges Q1, Q2 stay within the pressure-chamber inclusive flow paths 21 in the orthogonal direction, and at least areas adjoining the edges Q1, Q2 on an upper face of the flow path plate 11*c*, i.e., a face opposing the pressure chamber plate 11*b*, are exposed to the pressure-chamber inclusive flow path 21.

The manifold 24*a* is formed partly through the flow path plate 11*c* in a direction of the thickness, e.g., vertically. The manifold 24*a* includes a region 24*a*A, which is in a shape of a rectangular solid and is open both on an upper side and a lower side through an upper face and a lower face of the flow path plate 11*c*, and a region 24*a*B, which is in a shape of a rectangular solid and is open solely on a lower side through the lower face of the flow path plate 11*c* but is closed on an upper side. In other words, the manifold 24*a* is formed vertically through the flow path plate 11*c* in the region 24*a*A but is closed upward in the region 24*a*B. A length of the region 24*a*A and a length of the region 24*a*B in the arrayed direction are equal. The region 24*a*B is located between the region 24*a*A and the supplying flow paths 23 and communicates with the region 24*a*A and with lower part of the supplying flow paths 23. The region 24*a*B is formed by etching halfway the lower part of the flow path plate 11*c* between the region 24*a*A and the supplying flow paths 23 to an approximately middle of the thickness of the flow path plate 11*c*. In other words, the region 24*a*B forms an upward recess, of which recessed or closed end being an upper end is lower than an upper end of the region 24*a*A, and which is open downward, in the flow path plate 11*c*.

To the lower side of the flow path plate 11*c*, a damper sheet 16 with flexibility to cover the manifold 24*a* and the supplying flow paths 23 are adhered. The damper sheet 16 may attenuate pressure fluctuation of the ink in the manifold 24*a*. A spacer S having a shape of a frame is fixed to peripheral edges of the damper sheet 16.

As shown in FIGS. 2B and 3B, a plurality of pillars 18 are arranged in the manifold 24*a* at equal intervals in the arrayed direction to extend downward from a face 11*c*1, which forms the recessed end, or an upper end of the region 24*a*B, in the manifold 24*a*. The example in FIG. 3B shows two (2) pillars. Each pillar 18 has a cylindrical shape having an axial length being equal to a distance between the face 11*c*1 and the damper sheet 16, i.e., a height of the region 24*a*B. The pillars 18 may be formed integrally with the flow path plate 11*c*. The pillars 18 may be located at positions coincident in the arrayed direction with gaps, each between two (2) adjoining supplying flow paths 23, so that pillars 18 may not block the ink flowing from the manifold 24*a* toward the supplying flow paths 23. The pillars 18 may be formed by masking the portions, which will form the pillars 18, on the lower face of the flow path plate 11*c* with resist when the areas on the lower face of the flow path plate 11*c* between the region 24*a*A and the supplying flow paths 23 are half-etched.

The head 1 may be fabricated through a procedure to adhere the plurality of plates to one another to form layers. In the flow path plate 11*c*, the thinner portions formed by the half-etching are arranged between the manifold 24*a*, which is a through hole, and the supplying flow paths 23, which are arrayed in the arrayed direction. Therefore, during the adhering procedure, when an intense pressure in the direction of thickness is applied to the plates, the thinner portions may deform vertically, and the flow path plate 11*c* may be damaged at the gap portions between the supplying flow paths 23. In this regard, however, with the plurality of pillars 18 in the flow path plate 11*c*, the vertical deformation of the flow path plate 11*c* at the thinner portions may be restrained against the intense pressure during the adhering procedure. In other words, the flow path plate 11*c* may be restrained from being damaged at the gap portions between the supplying flow paths 23.

The protector plate 11*c* is adhered to lower face of the spacers S to cover the damper sheet 16. The damper sheet 16 is arranged to face the protector plate 11*d*, with a gap interposed there-between, to be protected by the protector plate 11*d*.

The nozzle plate 11*e* is formed to have the plurality of nozzle openings 22*b* being through holes, each of which communicates with one of the pressure pressure-chamber inclusive flow paths 21. The nozzle openings 22*b* are, as shown in FIG. 3C, arrayed at equal intervals in the same arrayed direction as the pressure chambers 21*b*. It may be noted that, in FIG. 3C, the position of the flow path plate 11*c* is indicated by broken lines for reference.

The reservoir plate 11*a* as shown in FIG. 3A is formed to have a reservoir 24*b*, which forms another part of the common flow path 24. The reservoir 24*b* extends, similarly to the manifold 24*a*, in the same direction as the pressure chamber array. The reservoir 24*b* is open downward through the lower face of the reservoir plate 11*a*. The reservoir plate 11*a* is adhered to the upper face of the flow path plate 11*c* and an upper face of protector member 15 in an arrangement such that the reservoir 24*b* overlaps the region 24*a*A in the manifold 24*a*. The protector member 15 has a raised portion, which is open downward. The actuator unit 12 is accommodated in the raised portion.

The reservoir plate 11*a* is formed to have the communication hole 25, which extends from a ceiling of the reservoir 24*b* to a top face of the reservoir plate 11*a*. The communication hole 25 is formed at a position in proximity to an end of the reservoir 24*b* in the arrayed direction, in which the pressure chambers 21*b* are arrayed. A tube, which is not shown, is connected to the communication hole 25 so that an ink storage, e.g., an ink cartridge, which is not shown, and the common flow path 24 communicate through the tube. In other words, the communication hole 25 provides a connection point, at which the tube forming an upstream flow path and the common flow path 24 are connected with each other. Thus, the ink flowing from the ink storage may be supplied to the common flow path 24 through the tube and the communication hole 25. Further, the ink supplied to the common flow path 24 may be supplied to the pressure chambers 21*b* through the anterior chambers 21*a* and the funnels 21*c*. The ink supplied to the pressure chambers 21*b* may be discharged through the descender flow paths 22*a* and from the nozzle openings 22*b* by operations of the actuator unit 12, which will be described further below.

The actuator unit 12 is arranged on an upper face of the pressure chamber plate 11*b* to cover the pressure-chamber inclusive flow paths 21. The actuator unit 12 includes a vibration board 12*a*, a common electrode 12*b*, a plurality of piezoelectric devices 12*c*, and a plurality of individual electrodes 12*d*, which are overlaid in this given order from bottom to top.

The vibration board 12*a* and the common electrode 12*b* are arranged on the upper face of the pressure chamber plate 11*b* to cover all of the pressure-chamber inclusive flow paths 21. Meanwhile, the piezoelectric devices 12*c* and the individual electrodes 12*d* are each provided to each one of the pressure chambers 21*b*. In other words, the piezoelectric devices 12*c*, the individual electrodes 12*d*, and the pressure chambers 21*b* are in one-to-one correspondence mutually and are arranged to overlap one another.

The vibration board 12*a* is a sheet of silicon dioxide, which may be generated by oxidizing a surface of a silicon single crystal board that forms the pressure chamber plate 11*b*. The common electrode 12*b* is common among the plurality of pressure chambers 21*b* and is arranged over the plurality of pressure chambers 21*b* at a position between the vibration board 12*a* and the piezoelectric devices 12*c*. The piezoelectric devices 12*c* may be made of a piezoelectric material, which includes, for example, a lead zilconate titanate (PZT), and are each arranged on an upper face of the common electrode 12*b* to overlap each of the pressure chambers 21*b*. The individual electrodes 12*d* are each arranged on an upper face of each piezoelectric device 12*c*. In other words, the individual electrodes 12*d* are each arranged at positions to overlap each of the pressure chambers 21*b*.

A protector sheet, which is not shown, is arranged over the common electrode 12*b* and the individual electrodes 12*d*, and wires 12*e* are arranged on the protector sheet. Each wire 12*e* is arranged to contact one of the individual electrodes 12*d* through holes that are formed through the protector sheet so that the wire 12*e* is electrically connected with the individual electrode 12*d*. The wires 12*e* and the common electrode 12*b* are connected to a Chip On Film (COF) board, which is not shown, and on which a driver IC is mounted. Meanwhile, the driver IC is connected with the controller 5.

The controller 5 may control behaviors of the common electrode 12*b* and the individual electrodes 12*d* in conjunction with the driver IC to maintain potential in the common electrode 12*b* at a constant level and, on the other hand, change potentials in the individual electrodes 12*d* according to ink discharging patterns to discharge the ink through the nozzle openings 22*b*. As the potential in some of the individual electrodes 12*d* changes, some of the piezoelectric devices 12*c* interposed between the individual electrodes 12*d* having the changed potential and the common electrode 12*b* may serve as actuators, which are deformable according to the potential in the individual electrodes 12*d*. In this regard, the actuator unit 12 has a plurality of actuators, each of which covers one of the pressure chambers 21*b*. Thus, an operation of the actuator, in other words, deformation of the actuator, e.g., deformation of the actuator to dent into the pressure chamber 21*b*, according to the potential in the individual electrode 12*d*, and deformation of the vibration board 12*a* caused by the deformation of the actuator may change a capacity of the pressure chamber 21*b*, so that the ink in the pressure chamber 21*b* may be pressurized and discharged through the nozzle opening 22*b*.

In the head 1 according to the embodiment, one (1) supplying flow path 23 is connected with two (2) pressure-chamber inclusive flow paths 21 which adjoin each other in the arrayed direction. Alternatively, for example, supplying flow paths and the pressure-chamber inclusive flow paths 21 may be provided in one-to-one correspondence. In other words, for two (2) pressure-chamber inclusive flow paths 21, two (2) smaller supplying flow paths may be formed. In this alternative arrangement, a total cross-sectional area of the two smaller supplying flow paths may be equal to a double of a cross-sectional area of the smaller supplying flow path. On the other hand, in the arrangement of the supplying flow paths 23 according to the present embodiment, in which one supplying flow path 23 is connected with two adjoining pressure-chamber inclusive flow paths 21, a total cross-sectional area of each supplying flow path 23 includes a cross-sectional area of a portion of the supplying flow path 23 between the two pressure-chamber inclusive flow paths 21. In this regard, the total cross-sectional area of the supplying flow path 23 may be larger than the double of the cross-sectional area of the smaller supplying flow path mentioned above. Therefore, without enlarging the size of each pressure chamber 21*b* in the arrayed direction, the size of each supplying flow path 23 in the arrayed direction may be increased. Accordingly, a potential resistance producible in the flow path between the common flow path 24 and the pressure chamber 21*b* may be reduced, and even if the ink with high viscosity is discharged in a high driving frequency, shortage of refilling ink may be restrained. Moreover, without the necessity of increasing the size of the pressure chambers 21*b* in the arrayed direction, the nozzle openings 22*b* may be arrayed at small intervals. Therefore, printing images in a high resolution may be achieved.

Moreover, according to the present embodiment, compared to an arrangement, in which each supplying flow path 23 is connected to three (3) or more pressure-chamber inclusive flow paths 21, strength in the flow path plate 11*c* with the supplying flow paths 23 may be maintained more effectively while shortage of the refilling ink may be restrained. Further, compared to the arrangement, in which each supplying flow path 23 is connected to three (3) or more pressure-chamber inclusive flow paths 21, cross talk between the pressure chambers 21*b* connected through the supplying flow path 23 may be restrained more effectively.

Meanwhile, for example, the pressure chamber plate may be arranged such that recesses may be formed by half-etching on a lower side of the pressure chamber plate, the recesses may each communicate with one of the pressure chambers, and through holes to each communicate with one of the recesses may be formed at upper positions with respect to the recesses in the pressure chamber plate. Thus, supplying flow paths may be formed to connect between a common flow path, which may be located on an upper side of the pressure chamber plate, and the pressure chambers. In this arrangement, however, the through holes may need to be formed at limited positions not to interfere with the common electrode 12*b* or the wires 12*e* in the actuator unit 12, which may cause difficulties in fabrication. In contrast, according to the present embodiment, the supplying flow paths 23 are arranged to extend from the pressure-chamber inclusive flow paths 21 in the same direction as the discharging flow paths 22. Therefore, the supplying flow paths 23 may be arranged on the lower side of the pressure-chamber inclusive flow paths 21 easily without being limited by the arrangement of the common electrode 12*b* or the wires 12*e*, which are formed on the upper side of the pressure-chamber inclusive flow paths 21, opposite to the nozzle openings 22*b*.

Moreover, the edges Q1, Q2 of the supplying flow path 23 on the one and the other end in the orthogonal direction are located on the inner side of the edges R1, R3 of the pressure-chamber inclusive flow path 21. In this regard, for example, when the head 1 is being assembled, minor displacement between the pressure chamber plate 11*a* and the flow path plate 11*b* or dimension errors in the pressure chamber plate 11*a* or the flow path plate 11*b* may occur. In such occasions, there may be a risk that the supplying flow paths 23 are partially closed by the pressure chamber plate 11*b* at the boundary Px, and the cross-sectional area of the supplying flow path 23 may be reduced. However, due to the arrangement of the edges Q1, Q2 of the supplying flow path 23 located on the inner side of the edges R1, R3 of the pressure-chamber inclusive flow path 21 in the orthogonal direction, the supplying flow paths 23 may be restrained from being closed by the pressure chamber plate 11*b* at the boundary Px, or the cross-sectional area of the supplying flow path 23 may be restrained from being reduced. Therefore, the shortage of the refilling ink may be restrained effectively.

Moreover, the length L1 of the supplying flow path 23 in the arrayed direction is equal to the length L2, which is a sum of the distance between two adjoining pressure-chamber inclusive flow paths 21 and the lengths of two of the pressure-chamber inclusive flow paths 21 in the arrayed direction. Therefore, compared to an arrangement, in which the length L1 of the supplying flow path 23 in the arrayed direction is smaller than the length L2, the potential resistance producible in the flow path may be reduced, and shortage of the refilling ink may be restrained more effectively. On the other hand, compared to an arrangement, in which the length L1 of the supplying flow path 23 in the arrayed direction is greater than the length L2, the interval between the supplying flow paths 23 may be enlarged, and the strength of the flow path plate 11*c* may be restrained from being lowered.

In the following paragraphs, examples of modification of the above embodiment will be described. In the examples described in the following paragraphs, items or structures which are substantially the same as or similar to those described in the above embodiment may be denoted by the same reference signs, and description of those may be omitted.

A first example of the modified embodiment is related to the pressure chamber plate. As shown in FIG. 4, two (2) adjoining pressure-chamber inclusive flow paths 51 communicate along the arrayed direction at a position overlapping the supplying flow path 23 in the orthogonal direction. In particular, between two adjoining pressure-chamber inclusive flow paths 51, a through hole is formed to connect the anterior chambers 51*a* in the adjoining pressure-chamber inclusive flow paths 51 with each other. Therefore, in the pressure chamber plate 41*b*, the two pressure-chamber inclusive flow paths 51 form a single through hole, which includes two (2) anterior chambers 51*a*, two (2) pressure chambers 51*b*, and two (2) funnels 51*c*. In this arrangement, potential resistance in the flow path may be reduced, and shortage of the refilling ink may be restrained more effectively. Meanwhile, a number of the pressure-chamber inclusive flow paths 51 to form a single through hole may not necessarily be limited to two, but three (3) or more pressure-chamber inclusive flow paths 51 may form a single through hole in the pressure chamber plate 41*b*.

A second example of the modified embodiment is related to the flow path plate. As shown in FIG. 5, a flow path plate 61*c* in the second example may be formed to have a single supplying flow path 63, which is elongated in the arrayed direction. A length L3 of the supplying flow path 63 in the arrayed direction may be equal to a length L4 (see FIG. 3A), which is a sum of a distance between two (2) of the plurality of pressure-chamber inclusive flow paths 21 at outmost positions in the arrayed direction and lengths of the outmost pressure-chamber inclusive flow paths 21 in the arrayed direction. In other words, the single supplying flow path 63 may be connected with all of the pressure-chamber inclusive flow paths 21 that adjoin one another in the arrayed direction. In the example shown in FIGS. 3A-3C, a quantity of the pressure-chamber inclusive flow paths 21 that may be connected with the single supplying flow path 63 is six (6). In this arrangement, a potential resistance producible in the flow path between the common flow path 24 and the pressure chambers 21*b* may be reduced to a lower level, and even if the ink with high viscosity is discharged in a high driving frequency, shortage of refilling ink may be restrained more effectively. It may be noted that in FIG. 5, and in FIGS. 6A-6B described below, the position of the communication hole 25 formed in the reservoir plate 11*a* is illustrated in broken lines.

A third example of the modified embodiment is again related to the flow path plate. As shown in FIG. 6A, a flow path plate 71*c* may be formed to have two (2) supplying flow paths 73*a*, 73*b* having different lengths in the arrayed direction. The supplying flow path 73*a* is separated farther from the communication hole 25 than the supplying flow path 73*b* in the arrayed direction. A length L5 of the supplying flow path 73*a* in the arrayed direction is equal to a length L6 (see FIG. 3A), which is a sum of a distance between two (2) outmost ones of four (4) adjoining pressure-chamber inclusive flow paths 21 in the arrayed direction and lengths of the two outmost pressure-chamber inclusive flow paths 21 in the arrayed direction. A length L7 of the supplying flow path 73*b* in the arrayed direction is equal to the length L2 (see FIG. 3A) mentioned above. In other words, the supplying flow path 73*a* may be connected with four (4) of the pressure-chamber inclusive flow paths 21 that adjoin one another in the arrayed direction, and the supplying flow path 73*b* may be connected with two (2) of the pressure-chamber inclusive flow paths 21 that adjoin each other in the arrayed direction.

A fourth example of the modified embodiment is again related to the flow path plate. As shown in FIG. 6B, a flow path plate 81*c* may be formed to have two (2) supplying flow paths 83*a* and one (1) supplying flow path 83*b*. A length of each supplying flow path 83*a* in the arrayed direction is greater than a length of the supplying flow path 83*b* in the arrayed direction. In this arrangement, the pressure chamber array is formed of eight (8) pressure chambers. Meanwhile, the communication hole 25 is formed at a position corresponding to a substantially central position in the arrayed direction for the eight pressure chambers. Therefore, the supplying flow paths 83*a* are both separated farther from the communication hole 25 than the supplying flow path 83*b* in the arrayed direction. A length L8 in each supplying flow path 83*a* in the arrayed direction is equal to a length L9 (see FIG. 3A), which is a sum of a distance between two (2) outmost ones of three (3) adjoining pressure-chamber inclusive flow paths 21 and lengths of the two outmost pressure-chamber inclusive flow paths 21 in the arrayed direction. A length L10 of the supplying flow path 83*b* in the arrayed direction is equal to the length L2 (see FIG. 3A) mentioned above. In other words, the supplying flow paths 83*a* each may be connected with three (3) of the pressure-chamber inclusive flow paths 21 that adjoin one another in the arrayed direction, and the supplying flow path 83*b* may be connected with two (2) of the pressure-chamber inclusive flow paths 21 that adjoin each other in the arrayed direction.

In the arrangements shown in FIGS. 6A and 6B, the supplying flow paths that are farther from the communication hole 25 in the arrayed direction are connected with a larger number of pressure-chamber inclusive flow paths 21. Therefore, unevenness in the ink-refilling abilities of the pressure chambers 21*b* due to the difference in distances in the arrayed direction from the communication hole 25 may be absorbed, and the uneven ink-refilling abilities due may be restrained from being amplified.

Although examples of carrying out the invention have been described, those skilled in the art will appreciate that there are numerous variations and permutations of the liquid discharging head that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the supplying flow path 23 may not necessarily consist solely of the connecting portion that extends straight from the boundary Px in the vertical direction. For example, a lower portion of the supplying flow path 23 may extend horizontally in a constant width in the arrayed direction to connect with the region 24*a*A. In this arrangement, the common flow path 24*a* may not include the region 24*a*B but may solely have the region 24*a*A.

For another example, in the arrangement, in which each supplying flow path 23 is connected with two (2) pressure-chamber inclusive flow paths 21 that adjoin each other in the arrayed direction, the length L1 of the supplying low path 23 in the arrayed direction may not necessarily be equal to the length L2 but may either be longer or shorter than the length L2. It may be noted that, in the arrangement, in which the length L1 is longer or shorter than the length L2, the potential resistance producible in the flow path may be similarly reduced to the arrangement, in which the length L1 is equal to the length L2; however, the distance between the two supplying flow paths may be shortened. Therefore, the strength of the plate may be lowered.

For another example, each pressure-chamber inclusive flow path may not necessarily have the anterior chamber or the funnel but may be formed solely of the pressure chamber.

The plates 11*a*-11*c* in the flow path member 11 may be grouped into at least three groups: a group of plate(s) to form the pressure-chamber inclusive flow paths 21, e.g., the pressure chamber plate 11*b;* a group of plates to form discharging flow paths 22, e.g., the flow path plate 11*c* and the nozzle plate 11*e;* and a group of plate(s) to form the supplying flow paths 23, e.g., the flow path plate 11*c*. In this regard, for another example, the plate(s) to form the pressure-chamber inclusive flow paths 21 may not necessarily be limited to the pressure chamber plate 11*b* alone, but two (2) or more plates may be assembled to form the pressure-chamber inclusive flow paths 21. For another example, the plates to form the discharging flow paths 22 may not necessarily be limited to the flow path pate 11*c* and the nozzle plate 11*e* alone, but three (3) or more plates that do not form the pressure-chamber inclusive flow paths may be assembled to form the discharging flow paths 22. For another example, the plate(s) to form the supplying flow paths 23 may not necessarily be limited to the flow path plate 11*c* alone, but two (2) or more plates including the flow path plate 11*c* may be assembled to form the supplying flow paths 23 as long as at least one of the plates that form the discharging flow paths 22 is included. Moreover, the plates to form the supplying flow paths 23 may include all of the plates that form the discharging flow paths 22.

For another example, a number of the pressure-chamber inclusive flow paths to be connected with each supplying flow path may not necessarily be limited to those described as the modified examples with reference to FIGS. 6A-6B, but any number of the pressure-chamber inclusive flow paths may be connected with a supplying flow path as long as a supplying flow path closer to the communication hole 25 in the arrayed direction is connected with a smaller number of pressure-chamber inclusive flow paths and a supplying flow path farther from the communication hole 25 in the arrayed direction is connected with a larger number of the pressure-chamber inclusive flow paths. For another example, at least one of the edges Q1, Q2 of the supplying flow path 23 may be located at the same as or an outer position than the edges of the pressure-chamber inclusive flow path 21 in the orthogonal direction.

For another example, two (2) or more pressure chamber arrays may be formed in each head. For another example, solely one (1) pillar may be provided to each pressure chamber array. For another example, no pillar may be provided in the pressure chamber array. For another example, the pillars may be arranged at positions coincident with the supplying flow paths in the arrayed direction. For another example, the height of the pillars may be smaller than the height of the recess or the region 24*a*B in the manifold 24*a*.

For another example, the actuators may not necessarily be limited to the device to piezoelectrically pressurize the pressure chambers but may be a device that may pressurize the pressure chambers in a different style, such as a thermally pressurizing device with a heating element or an electrostatically pressurizing device using electrostatic force.

For another example, the liquid discharging head may not necessarily be limited to the line-printing head but may be a serially discharging head that may discharge the liquid at a discharging target through nozzles while the head moves in a scanning direction parallel to a width of the target. For another example, the liquid to be discharged through the nozzle openings may not necessarily be limited to ink but may be any other liquid. For example, a processing agent to agglutinate or precipitate components in the ink may be discharged. For another example, the head described in the present disclosure may be applicable not only to a printer but also to, for example, a facsimile machine, a copier, and a multifunction peripheral.

What is claimed is:

1. A liquid discharging head, comprising:

an actuator; and a flow path member including a plurality of plates being layered, the flow path member being formed to have:

a common flow path extending in a first direction;

a plurality of pressure-chamber inclusive flow paths formed in a part of the plurality of plates belonging to a first plate group, each of the plurality of pressure-chamber inclusive flow paths including a pressure chamber, the plurality of pressure-chamber inclusive flow paths being arrayed in the first direction;

a plurality of discharging flow paths formed in another part of the plurality of plates not belonging to the first plate group but belonging to a second plate group, each of the plurality of discharging flow paths extending in a second direction from the pressure chamber in each of the plurality of pressure-chamber inclusive flow paths, the second direction intersecting orthogonally with the first direction, each of the plurality of discharging flow paths having a nozzle opening at one end thereof; and at least one supplying flow path formed in at least one of the plurality of plates belonging to a third plate group, the third plate group including at least one of the part of the plurality of plates belonging to the second plate group, the at least one supplying flow path connecting the common flow path with the plurality of pressure-chamber inclusive flow paths, each of the at least one supplying flow path having a connecting portion, the connecting portion extending from one end on a boundary with one of the plurality of pressure-chamber inclusive flow paths in parallel with a direction extending from the pressure chamber toward the nozzle opening in each of the pressure-chamber inclusive flow paths, wherein each connecting portion is connected with at least two of the plurality of pressure-chamber inclusive flow paths.

2. The liquid discharging head according to claim 1, wherein each connecting portion is connected with two of the plurality of pressure-chamber inclusive flow paths adjoining each other in the first direction.

3. The liquid discharging head according to claim 1, wherein the at least one supplying flow path is a single supplying flow path; and wherein the connecting portion in the single supplying flow path is connected with all of the plurality of pressure-chamber inclusive flow paths arrayed in the first direction.

4. The liquid discharging head according to claim 1, wherein two edges of the connecting portion in a third direction intersecting orthogonally with the first direction and the second direction on the boundary are located on an inner side of edges of each of the plurality of pressure-chamber inclusive flow paths in the third direction.

5. The liquid discharging head according to claim 1, wherein the common flow path is connected with an upstream flow path at a connection point, the upstream flow path being configured to supply liquid to the common flow path;

wherein a first connecting portion being the connecting portion in one of the at least one supplying flow path connected with m pressure-chamber inclusive flow paths, m being a natural number; and wherein a second connecting portion, being the connecting portion in another one of the at least one supplying flow path located farther in the first direction than the first connecting portion from the connection point, is connected with n pressure-chamber inclusive flow paths, n being a natural number larger than m.

6. The liquid discharging head according to claim 1, wherein an outline of a cross-sectional shape of the connecting portion on a plane spreading orthogonally to a flowing direction for liquid has no corner.

7. The liquid discharging head according to claim 1, wherein a length of the connecting portion in the first direction is equal to a sum of a length between two pressure-chamber inclusive flow paths located at outmost positions in the first direction among the plurality of pressure-chamber inclusive flow paths connected with the connecting portion and lengths of two supplying flow paths of the at least one supplying flow path in the first direction.

8. The liquid discharging head according to claim 1, wherein the plurality of pressure-chamber inclusive flow paths connected with the connecting portion communicate along the first direction with one another at a same position as the connecting portion in a third direction, the third direction intersecting orthogonally with the first direction and the second direction.

9. The liquid discharging head according to claim 1, wherein a part of the common flow path adjoining the connecting portion forms a recess being open on one end in the direction from the pressure chamber toward the nozzle opening in one of the plurality of plates; and wherein at least one pillar is arranged on the other end of the recess.

10. A liquid discharging head, comprising:

an actuator; and a flow path member, the flow path member being formed to have:

a common flow path extending in a first direction;

a nozzle opening;

a plurality of pressure-chamber inclusive flow paths each including an anterior chamber, a pressure chamber, and a funnel, the funnel being a narrowed flow path formed between the anterior chamber and the pressure chamber;

a descender flow path connecting the pressure chamber with the nozzle opening in a second direction, the second direction intersecting orthogonally with the first direction; and a supplying flow path connecting the common flow path with the anterior chamber, wherein the supplying flow path is connected with at least two of the plurality of pressure chamber inclusive flow paths each through the anterior chamber.

11. The liquid discharging head according to claim 10, wherein the supplying flow path is connected with all of the plurality of pressure-chamber inclusive flow paths arrayed in the first direction.

12. The liquid discharging head according to claim 10, wherein the supplying flow path includes a first supplying flow path and a second supplying flow path, the second supplying flow path being different from the first supplying flow path.

13. The liquid discharging head according to claim 12, wherein the first supplying flow path is connected with a larger number of the plurality of pressure-chamber inclusive flow paths than the second supplying flow path.

14. The liquid discharging head according to claim 12, wherein a size of the first supplying flow path is larger than a size of the second supplying flow path.

15. The liquid discharging head according to claim 12, wherein the flow path member is formed to further have a pillar; and wherein the pillar is located between the first supplying flow path and the second supplying flow path in the first direction.

16. The liquid discharging head according to claim 12, wherein the supplying flow path includes a third supplying flow path, the third supplying flow path being different from the first supplying flow path and the second supplying flow path;

wherein the second supplying flow path is located between the first supplying flow path and the third supplying flow path in the first direction; and wherein the second supplying flow path is smaller than the first supplying flow path and the third supplying flow path in the first direction.

17. A liquid discharging head, comprising:

an actuator; and a flow path member including a first plate, a second plate, and a third plate, wherein the first plate has a first through hole for a common flow path extending in a first direction and second through holes, the second through holes each including an anterior chamber, a pressure chamber, and a funnel;

wherein the second plate has a plurality of nozzle openings;

wherein the third plate has a third through hole for the common flow path, a plurality of fourth holes each for a descender flow path, and a fifth hole for a supplying flow path;

wherein the plurality of fourth holes each connect one of a plurality of pressure chambers included in the second through holes with one of the plurality of the nozzle openings in a second direction, the second direction intersecting orthogonally with the first direction; and wherein the fifth hole connects the third through hole with at least two anterior chambers included in the second through holes.

* * * * *